US008388070B2

(12) United States Patent
von Schönebeck et al.

(10) Patent No.: US 8,388,070 B2
(45) Date of Patent: Mar. 5, 2013

(54) MINING MACHINE, IN PARTICULAR SURFACE MINER, AS WELL AS METHOD FOR THE REMOVAL AND INSTALLATION OF A TRANSPORT DEVICE IN A MINING MACHINE

(75) Inventors: Winfried von Schönebeck, Vettelschoss (DE); Thomas Mannebach, Langenfeld (DE); Cyrus Barimani, Konigswinter (DE); Günter Hähn, Königswinter (DE)

(73) Assignee: Wirtgen GmbH (DE)

( * ) Notice: Subject to any disclaimer, the term of this patent is extended or adjusted under 35 U.S.C. 154(b) by 361 days.

(21) Appl. No.: 12/723,824

(22) Filed: Mar. 15, 2010

(65) Prior Publication Data

US 2010/0237681 A1 Sep. 23, 2010

(30) Foreign Application Priority Data

Mar. 20, 2009 (DE) ..... 20 2009 003 824 U

(51) Int. Cl.
*B65G 19/24* (2006.01)

(52) U.S. Cl. ..... 299/39.2; 198/584; 198/861.1

(58) Field of Classification Search ..... 299/39.2; 198/861.3, 861.5, 589, 592, 584, 318
See application file for complete search history.

(56) References Cited

U.S. PATENT DOCUMENTS 4,063,375 A * 12/1977 Satterwhite ..... 37/190
4,186,968 A * 2/1980 Barton ..... 299/39.2
4,342,485 A 8/1982 Tuneblom
4,834,463 A * 5/1989 Nye ..... 299/39.2
4,960,306 A 10/1990 Kipp et al.
4,966,418 A * 10/1990 Wirtgen ..... 299/39.2
5,577,808 A * 11/1996 Gilbert ..... 299/39.2
5,695,256 A * 12/1997 Kishimoto ..... 299/39.2
2008/0315666 A1 12/2008 Von Schonebeck et al.

FOREIGN PATENT DOCUMENTS

DE 202005005919 U1 6/2005

* cited by examiner

*Primary Examiner* — John Kreck
(74) *Attorney, Agent, or Firm* — Waddey & Patterson, P.C.; Lucian Wayne Beavers

(57) ABSTRACT

In a mining machine (1) for the processing of a ground (3), in particular surface miner, with a machine frame (2), a cutting drum (4) mounted in the machine frame (2), a first transport device (6), which accepts mining material from the cutting drum (4), a second transport device (12), which accepts the mining material from the first transport device (6) at a point of acceptance (18) that is arranged at the lower end (14) of the second transport device (12) and is located below the upper end (22) of the first transport device (6), a conveyor suspension device (10) for the second transport device (12), which is mounted at the machine frame (2) to slew about a vertical slewing axis (8), where the second transport device (12) is pivotable about a first horizontal pivoting axis (24) that runs transverse to the longitudinal direction of the second transport device (12) and is mounted in the conveyor suspension device (10), and where the vertical slewing axis (8) of the conveyor suspension device (10) runs essentially centrally through the point of acceptance (18), it is provided that the conveyor suspension device (10), together with the second transport device (12), is pivotable, relative to the machine frame (2), about a second horizontal pivoting axis (28).

18 Claims, 5 Drawing Sheets

MINING MACHINE, IN PARTICULAR SURFACE MINER, AS WELL AS METHOD FOR THE REMOVAL AND INSTALLATION OF A TRANSPORT DEVICE IN A MINING MACHINE

We, Winfried von Schonebeck, a citizen of Germany, residing at Vettelschoss, Germany; Thomas Mannebach, a citizen of Germany, residing at Langenfeld, Germany; Cyrus Barimani, a citizen of Germany, residing at Königswinter, Germany; and Günter Hähn, a citizen of Germany, residing at Königswinter, Germany, have invented a new and useful "Mining Machine, In Particular Surface Miner, As Well As Method For The Removal And Installation Of A Transport Device In A Mining Machine". This application claims priority from German Utility Model Application No. 20 2009 003 824.6 filed Mar. 20, 2009.

BACKGROUND OF THE INVENTION

The invention relates to a mining machine, in particular a surface miner, as well as a method for the removal and installation of a transport device in a mining machine.

Such mining machines are employed in opencast mining, earthwork and rock operations, where such a mining machine cuts, crushes and loads rock, for instance, in a single operational step without requiring blasting operations.

The mining machine is also suitable for the exploitation of gypsum, soft limestone or coal. A cutting drum is used as the mining tool, which transfers the mining material to a first transport device that is arranged inside the machine frame in a permanent yet replaceable fashion. The mining material is transported diagonally upwards on the first transport device to a point of discharge, where the mining material is discharged onto a second transport device, the lower end of which is located below the upper end of the first transport device. The second transport device transports the mining material from a point of acceptance at the lower end of the second transport device also upwards to a point of discharge, where the mining material can be discharged either onto a transport vehicle or else to the side of the mining machine. To this effect, the second transport device is slewable laterally about ±90° to either side by means of a conveyor suspension device for the second transport device, which is slewable about a vertical axis that passes through the point of acceptance in a virtual fashion. In addition, the second transport device is pivotable about a horizontal pivoting axis in order to bring the upper end of the second transport device to a desired discharge height. The parameters vertical and horizontal are to be understood to mean that the mining machine is standing on horizontal ground.

Such mining machines create the disadvantage that, as a result of the mining material being transferred from the first transport device to the second transport device, the transport devices inevitably overlap. In particular with sharp-edged mining material, it is necessary to replace the transport belt of a transport device in the event of the same being damaged.

Removal of the first transport device is also frequently required in the event of other operational malfunctions of the first, permanently installed transport device. Removal of the first transport device is significantly impeded, however, by the arrangement of the second transport device, with damage being caused to the second transport device during removal representing an additional risk. As a result, installation and removal of the first transport device is extremely time-consuming as, for instance, the transport belt cannot be replaced with the first transport device being in the installed position.

SUMMARY OF THE INVENTION

It is therefore the object of the invention to create a mining machine of the type first mentioned above, as well as a method for the installation and removal of a permanently installed transport device in a mining machine, which enable the installation and removal of the transport device with little expenditure of time.

The invention provides in an advantageous manner that the conveyor suspension device, together with the second transport device, is pivotable about a second horizontal pivoting axis relative to the machine frame. The second transport device, together with the conveyor suspension device carrying it, can thus be pivoted about a certain angle, for instance, of 30°, so that the lower end of the second transport device is no longer located below the upper end of the first transport device. To this effect, machine elements are used in an advantageous manner which are present in the mining machine already. The conveyor suspension device is connected to the machine frame in an articulated fashion, and the second pivoting axis is provided at the conveyor suspension device in such a fashion that the conveyor suspension device, together with the second transport device, can be pivoted out of the area of overlap.

To this effect, the second horizontal pivoting axis is offset, at least in vertical direction, upwards relative to the first pivoting axis.

It may be provided that the second horizontal pivoting axis shows, at least during pivoting of the conveyor suspension device, a vertical distance to the ground that is larger than the direct distance of the pivoting axis to the lower outer end of the second transport device.

It is preferably provided that the conveyor suspension device is capable of being locked in a working position for slewing of the second transport device and in a pivoting position for the installation and removal of the first transport device.

The conveyor suspension device is pivotable relative to the machine frame, with the second horizontal pivoting axis being supported in an element of the machine frame in which locking devices may also be provided that lock the conveyor suspension device in two different pivoting positions.

In detail, the element of the machine frame comprises plates which are arranged on both sides of the conveyor suspension device and, on the one hand, support the second horizontal pivoting axis at its ends and, on the other hand, are provided with bores which are offset in an angular fashion about a desired angle, e.g. 30°, relative to the second horizontal pivoting axis. Bolts engage with the conveyor suspension device through said bores, enabling the conveyor suspension device to be secured in the respective angular positions. It is understood that the locking bolts may be set not only manually but may also be brought into a locking or releasing position by means of a drive.

A slewing ring mounted on the machine frame is slewable about the vertical slewing axis and carries, on one side of the slewing ring, the conveyor suspension device for the second transport device. A counterweight may additionally be provided on the opposite side.

The counterweight serves the purpose of compensating the moments acting on the machine frame as a result of the weight loading and the slewing position of the second transport device.

Pivoting of the conveyor suspension device may be effected by means of a motorized aid, in which case, for example, in the area of the second horizontal pivoting axis, a preferably hydraulic rotational drive, possibly combined with a reduction gear, pivots the conveyor suspension device about the second horizontal pivoting axis relative to the machine frame.

Alternatively, a positioning mechanism fastened to the slewing ring or to the machine frame may engage with the conveyor suspension device at a vertical distance from the second horizontal pivoting axis in order to pivot the conveyor suspension device about the second horizontal pivoting axis.

For example, a positioning mechanism of a moving mechanism for the counterweight may also be used for pivoting of the conveyor suspension unit.

The second transport device is provided with a continuously revolving transport belt which is guided over a drive roller and a return roller at the ends on both sides. The drive roller is preferably arranged at the upper end of the second transport device and can, for the purpose of tensioning, be moved outwards via a belt tensioning device.

In accordance with prior art, it is provided to move the axis of the drive roller by means of threaded bolts. To this effect, a mechanic would need to proceed to the upper point of the second transport device, the end of which may be located at a considerable height. It is understood that this involves a significant expenditure of time.

In an advantageous further development of the mining machine, it is therefore provided that the belt tensioning device consists of a grease tensioner. This offers the advantage that the belt tensioning device can be operated from a remote location.

A grease feeding device for the grease tensioner may be provided, for example, which extends across the entire length of the second transport device and which is provided, at the lower end of the second transport device or at the machine frame, with a grease feeding connection in such a fashion that the grease feeding connection is accessible to a person standing on the ground.

In working position, the conveyor suspension device is connected to the machine frame via the second horizontal pivoting axis, and is secured in the working position by means of locking bolts which are guided through an element of the machine frame and which engage with the conveyor suspension device.

When the permanently installed transport device is to be removed, the locking device for the pivoting position of the conveyor suspension device is released first, and the conveyor suspension device is then pivoted, by means of a drive, about the second horizontal pivoting axis until the desired and preselected pivoting position has been reached. Subsequently, the locking devices are inserted again in order to lock the conveyor suspension device in the pivoting position.

Pivoting the conveyor suspension device also pivots the lower end of the second transport device in such a fashion that the same no longer overlaps with the upper end of the permanently installed transport device that is mounted inside the machine frame. The permanently installed transport device, which is detached from the machine frame at the upper end first, can then be lowered by means of, for instance, a lifting device, in particular a rope-and-pulley device.

In a third step, the lower end can be detached from the machine frame. The conveyor suspension device can then be pivoted back into its working position and locked therein. Once the removed first transport device rests freely on the ground, the required maintenance procedures, for instance, the replacement of a belt, can be performed with ease of access. Installation of the first transport device is effected in reverse sequence.

BRIEF DESCRIPTION OF THE DRAWINGS

In the following, one embodiment of the invention is explained in greater detail with reference to the drawings.

The following is shown.

DETAILED DESCRIPTION

Figure 1:
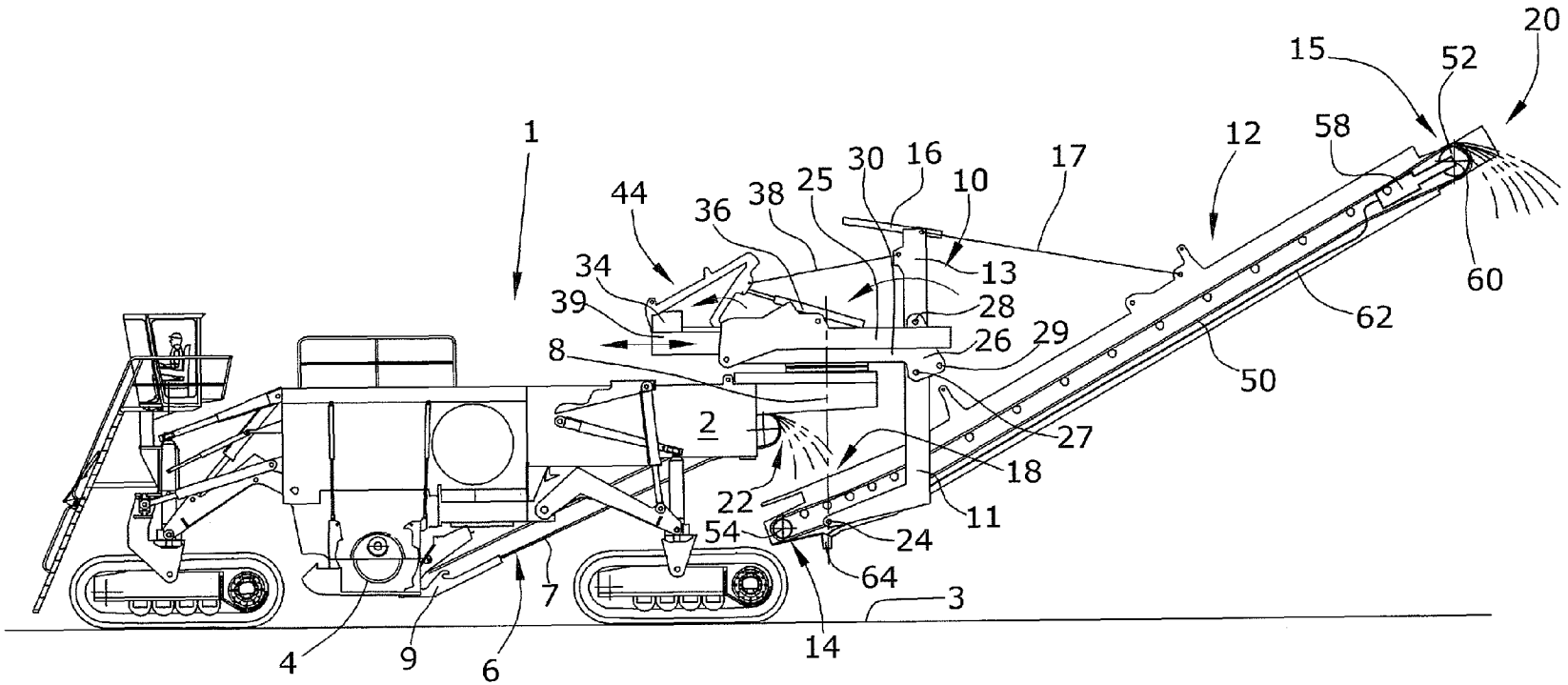
FIG. 1 a mining machine, in particular a surface miner, with a first and second transport device in locked working position, FIG. 2 the conveyor suspension device in locked pivoting position, FIG. 3 disassembly of the permanently installed transport device, and driving away of the mining machine, FIG. 4 pivoting back of the conveyor suspension device, FIG. 5 fastening of the first transport device to the machine frame, and FIG. 6 the first transport device in removal position.

FIG. 1 shows a mining machine 1, namely a surface miner for the processing of mining material, such as rock, limestone or coal and similar.

The mining machine 1 comprises a machine frame 2 in which a cutting drum 4 is supported that is used to mill off the mining material from the ground 3. To this effect, the cutting drum 4 shown in FIG. 1 is lowered to the ground 3 and brought to a pre-selected milling depth. Owing to its rotating movement, the cutting drum 4 throws the mining material onto a first transport device 6 supported in the machine frame 2 in a permanent yet removable fashion, said first transport device 6 extending, starting from the cutting drum 4, diagonally upwards in the machine frame 2. The first transport device 6 has a continuously revolving transport belt 7, which discharges the mining material at the upper rear end 22 of the first transport device 6 onto a point of acceptance 18 of a second transport device 12. The first transport device 6 is suspended in a conveyor shoe 9 at its lower front end, and is fastened to the machine frame in a detachable fashion at its upper end 22.

The second transport device 12 is also provided with a continuously revolving transport belt 50, which transports the mining material from the point of acceptance 18 in the lower area of the second transport device 12 to a point of discharge 20 where the mining material can be loaded on a vehicle or can also be discharged to the side on the ground 3.

The second transport device 12 is carried by a conveyor suspension device 10 which is fastened to the machine frame 2 in a pivotable fashion. The second transport device 12 has a lower end 14 and an upper end 15. The conveyor suspension device 10 comprises, for instance, a portal 13 which holds the second transport device 12 between struts 11. The parallel, preferably vertically extending struts 11 of the portal 13 are angled, at their lower end, towards the front in the direction of the machine frame 2, and accommodate, at their end facing the lower end 14 of the second transport device 12, a horizontal pivoting axis 24 in order to support the second transport device 12 in the conveyor suspension device 10 in a pivotable fashion. A positioning mechanism 16 in connection with a wire rope 17, which are mounted at the upper end of the portal 13 in a pivotable fashion, enable the second transport device 12 to be altered with regard to its angle of incline, and thus the height of the point of discharge 20 to be determined. To this effect, the wire rope 17 engages preferably in the upper third of the second transport device 12.

The conveyor suspension device 10 is pivotable about a second horizontal pivoting axis 28, which is supported in the vertical struts 11 on the one hand, and at an element 25 of the machine frame 2 on the other. The element 25 of the machine frame 2 comprises two plates 26 of essentially triangular shape which are provided, at their lower end, with holes 27 and 29 for locking bolts to be passed through. The holes 27 and 29 are spaced in an angular fashion about a desired pivoting angle for the conveyor suspension device 10. This pivoting angle may, for instance, be 30°. In the working position shown in FIG. 1, locking bolts are inserted in the holes 27 so that the struts 11 of the conveyor suspension device 10 are locked in vertical position. In the pivoting position of the conveyor suspension device 10 shown in FIG. 2, the locking bolts are placed in the holes 29, namely in both struts 11 that run parallel to one another on both sides of the second transport device 12. The conveyor suspension device 10 is thus locked in the pivoting position shown in FIG. 2.

To pivot the conveyor suspension device 10, a positioning mechanism 36 is used in connection with a pull rope 38 that engages, at a vertical distance from the pivoting axis 28, at the upper end of the struts 11, namely preferably at both struts 11 of the portal 13.

The positioning mechanism 36 may be directly coupled to the machine frame 2 or, as shown in the drawings, may be fastened to a slewing ring 30 which is slewable about a vertical axis 8 relative to the machine frame 2 about, for instance, ±90°, thus allowing slewing of the second transport device 12 to the side via the conveyor suspension device 10.

A movable counterweight 34 may be arranged at the slewing ring 30 on the opposite side of the conveyor suspension device 10, said counterweight 34 being capable of being moved to different positions for the purpose of reducing any moments acting on the machine frame 2. The counterweight 34 can therefore be moved outwards to different extents in accordance with the degree of loading of the second transport device 12 with mining material and in accordance with the lateral slewing position and vertical pivoting position of the second transport device 12. The positioning mechanism 36 mentioned earlier may be used to this effect, which is capable of moving the counterweight 34 outwards to different extents on a slide 39 by means of a link mechanism 44.

As explained earlier, the positioning mechanism 36 may also be used in an advantageous manner to pivot the conveyor suspension device 10.

Figure 2:
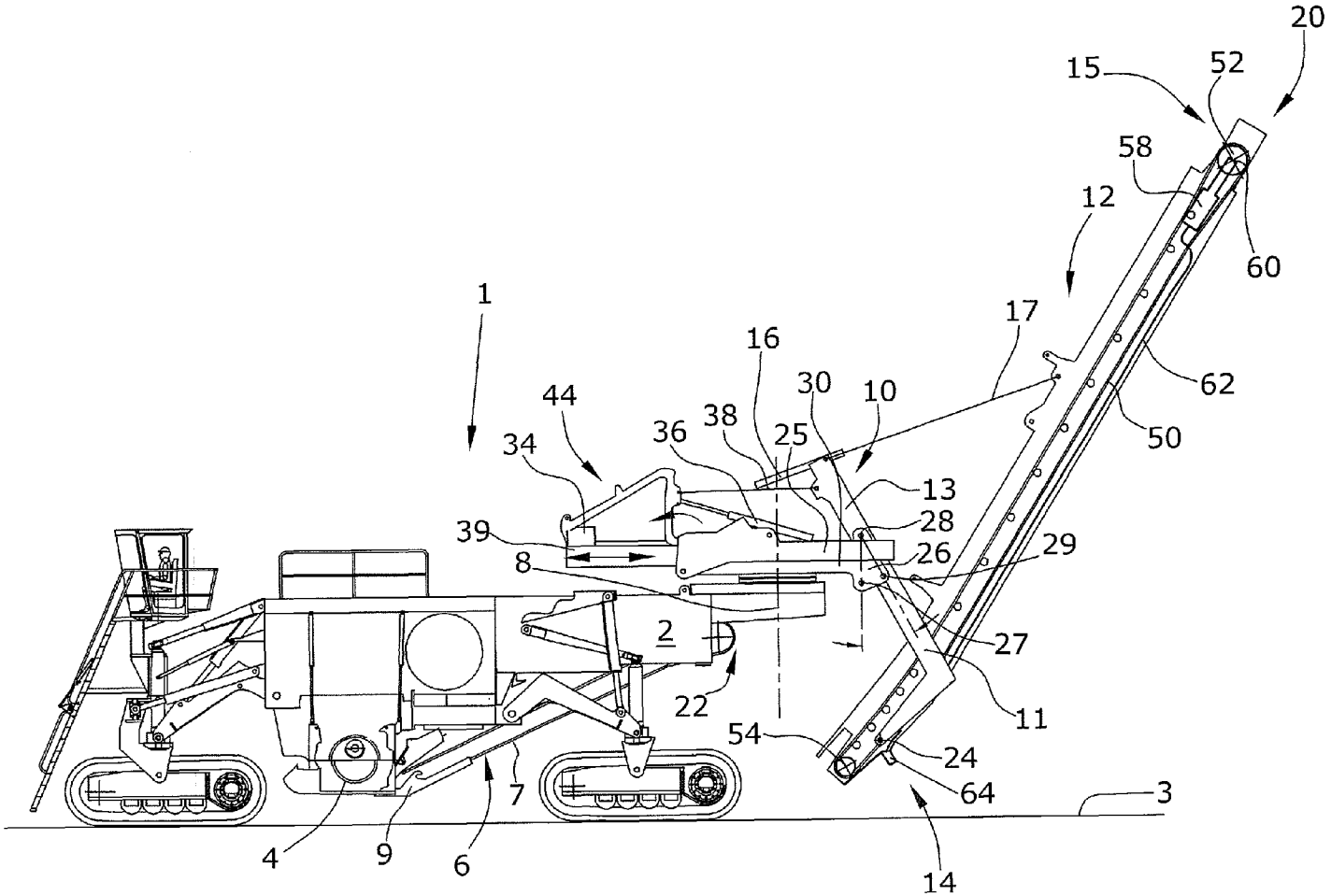
Figure 3:
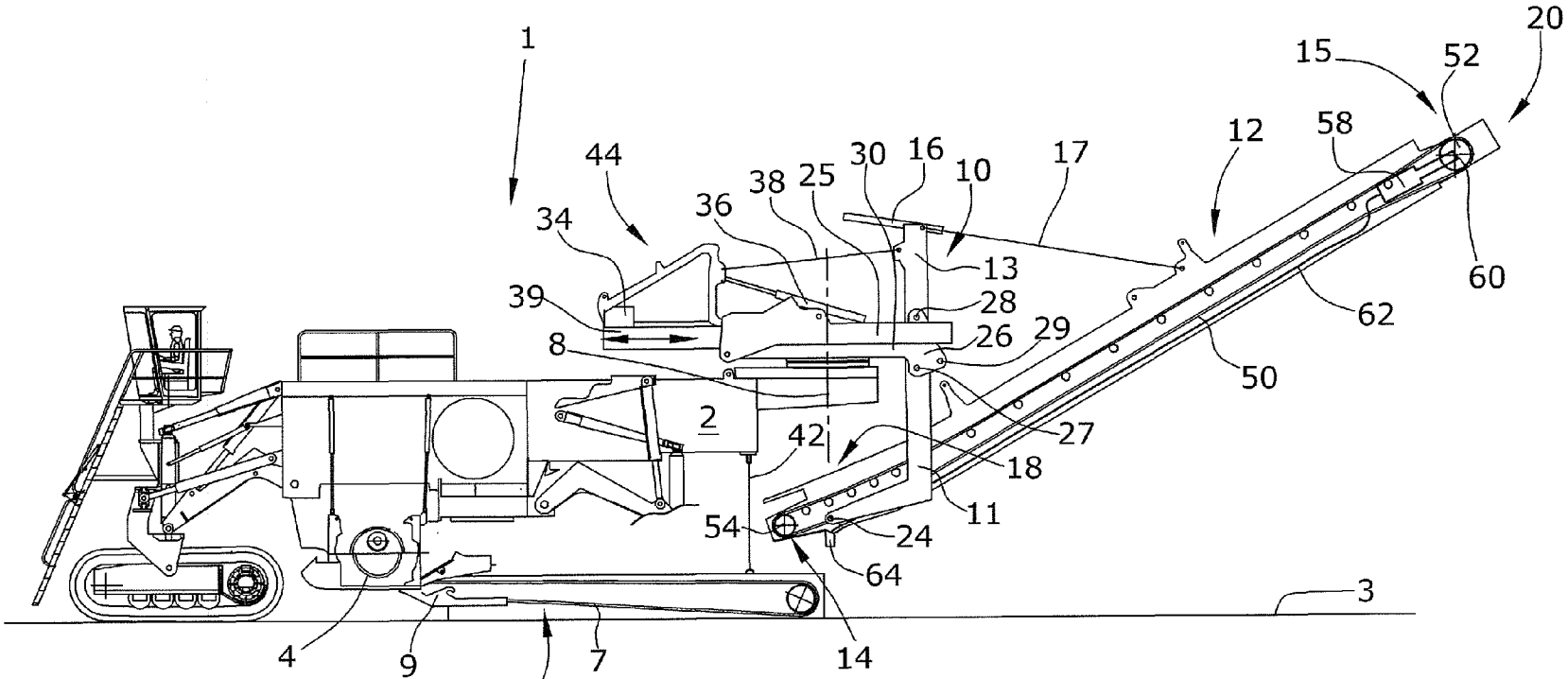
Figure 4:
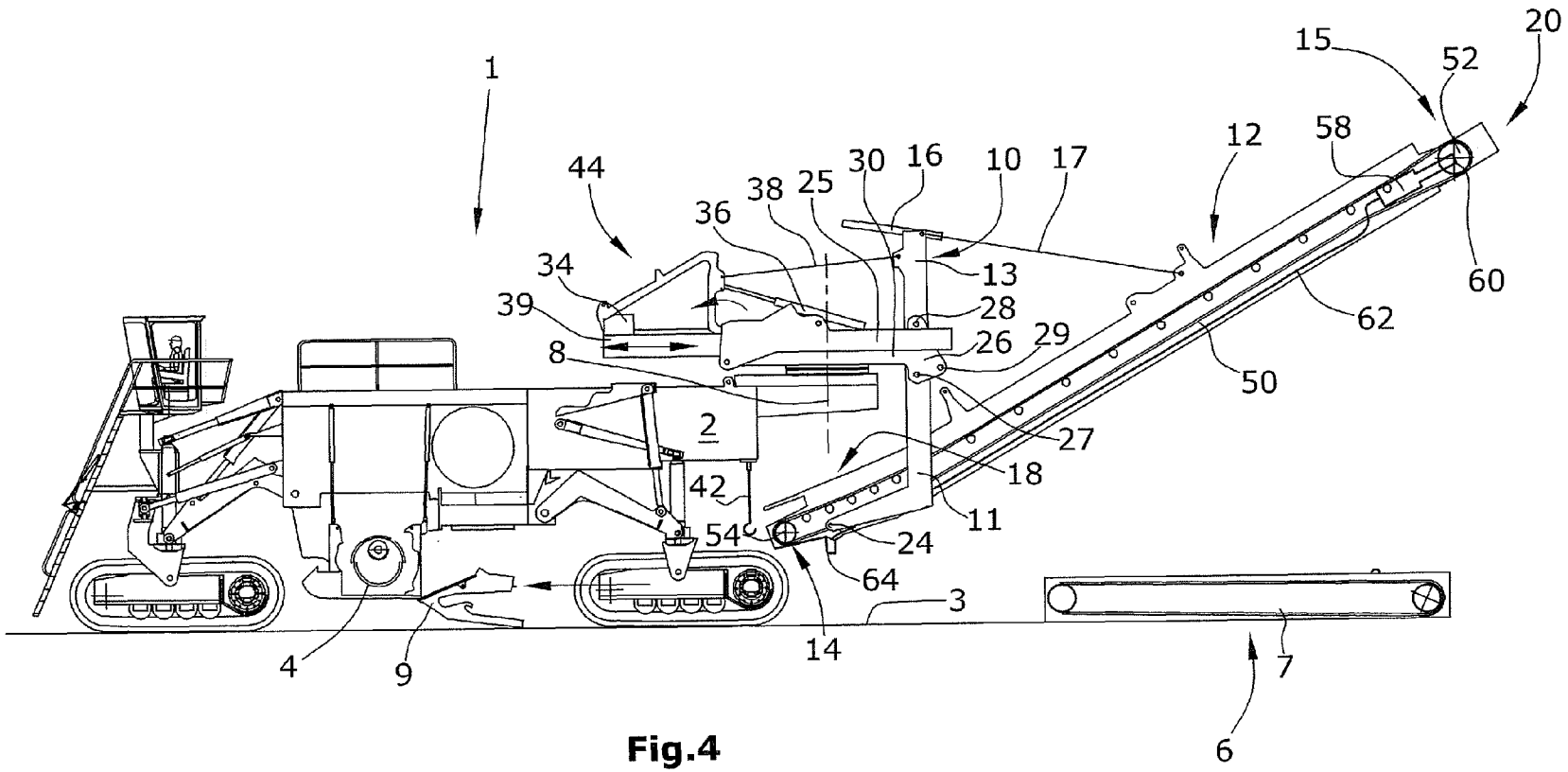

In the position shown in FIG. 2, the first transport device can be disassembled by first detaching the front end 22 of the first transport device 6 from the machine frame 2, and the first transport device then being lowered, as shown in FIG. 3, via a lifting device, for instance, a rope-and-pulley device. FIG. 3 shows the first transport device 6 in lowered position, in which the conveyor suspension device 10 has been pivoted back into the working position. It is understood that the conveyor suspension device 10 may remain in the pivoting position.

After lowering of the front end of the first transport device 6, the fastening means of the first transport device 6 at the conveyor shoe 9 can be detached, thereby enabling the first transport device 6 to be entirely detached from the machine frame 2.

Figure 5:
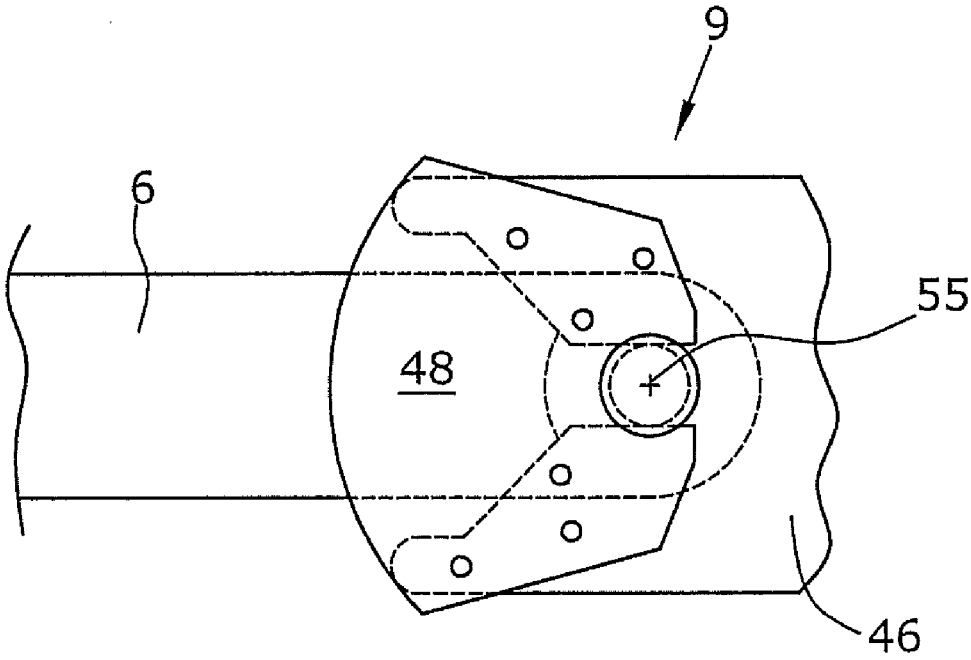
Figure 6:
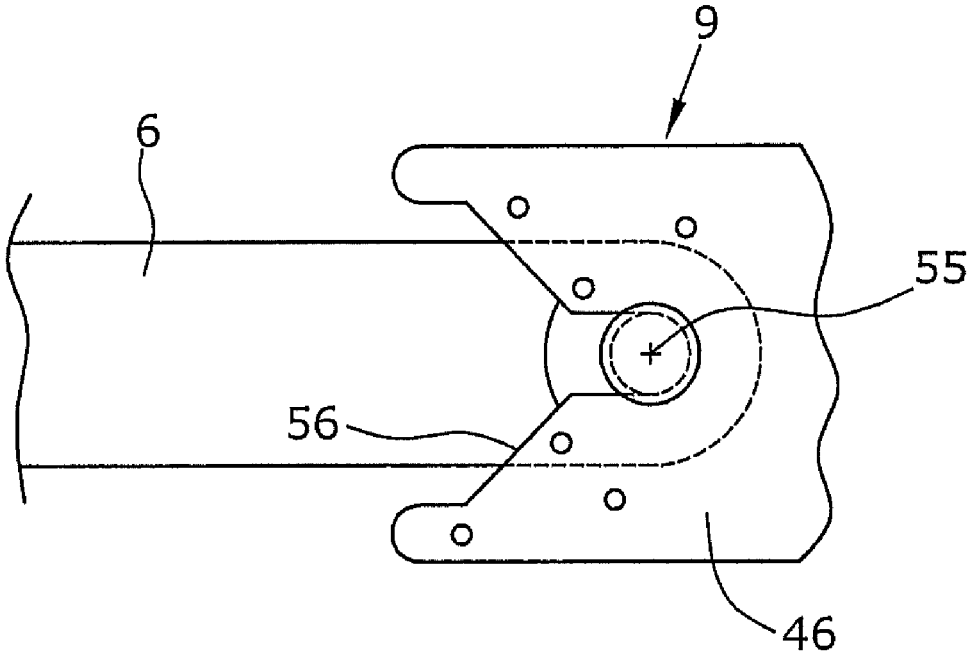

The mining machine 1 can subsequently be driven away in forward direction, which results in the first transport device 6 being fully exposed so that maintenance procedures can be carried out quite easily. FIGS. 5 and 6 show the holding device 46 for the lower front end of the first transport device 6 at the conveyor shoe 9.

FIG. 5 shows a side view of a mounting plate 48 which can be used to fasten the first transport device 6 to the conveyor shoe 9 on both sides. Bearing bolts 55 projecting in lateral direction from the first transport device 6 can be extracted, after removal of the mounting plates 48 on both sides, from the holder 46, for instance, by means of moving the mining machine 1 forward, in which case the laterally projecting bearing bolts 55 can glide down on the slants 56 on both sides of the conveyor shoe and can set the first transport device 6 down on the ground 3.

Tension of the transport belt 50 of the second transport device 12 can be maintained by means of a belt tensioning device consisting of a grease filled tensioning cylinder also referred to as a grease tensioner 58, with the grease tensioner acting on the linearly movable axle 60 of the upper drive roller 52 of the transport belt 50.

The continuously revolving transport belt 50 is driven via the upper drive roller 52 and is returned via the lower return roller 54. The grease tensioner 58 comprises a grease feeding device 62 that extends downwards along the second transport device 12 and leads to a grease feeding connection 64 which is accessible from the ground 3.

The invention claimed is:

1. Mining machine for the processing of a ground, with a machine frame, a cutting drum mounted in the machine frame, a first transport device which accepts mining material from the cutting drum, a second transport device which accepts the mining material from the first transport device at a point of acceptance arranged at a lower end of the second transport device and located below an upper end of the first transport device, a conveyor suspension device for the second transport device, which conveyor suspension device is mounted at the machine frame to slew about a vertical slewing axis, where the second transport device is pivotable about a first horizontal pivoting axis that runs transverse to a longitudinal direction of the second transport device and is mounted in the conveyor suspension device, and where the vertical slewing axis of the conveyor suspension device runs essentially centrally through the point of acceptance, characterized in that the conveyor suspension device, together with the second transport device, is pivotable, relative to the machine frame, about a second horizontal pivoting axis.

2. Mining machine in accordance with claim 1, characterized in that the second horizontal pivoting axis is located, at least during pivoting of the conveyor suspension device, a vertical distance from the ground that is larger than a direct distance from the pivoting axis to the lower end of the second transport device.

3. Mining machine in accordance with claim 1, characterized in that the conveyor suspension device is capable of being locked in a working position and in a pivoting position for the installation and removal of the first transport device.

4. Mining machine in accordance with claim 1, further comprising a slewing ring mounted on the machine frame, the slewing ring being slewable about a vertical slewing axis and carrying the conveyor suspension device.

5. Mining machine in accordance with claim 4, characterized in that the slewing ring carries a counterweight on a side of the slewing ring opposite from the conveyor suspension device.

6. Mining machine in accordance with claim 1, further comprising a rotational drive which pivots the conveyor suspension device relative to the machine frame about the second horizontal pivoting axis.

7. Mining machine in accordance with claim 4, further comprising a positioning mechanism fastened to the slewing ring or to the machine frame and engaging the conveyor suspension device at a vertical distance from the second horizontal pivoting axis in order to pivot the conveyor suspension device about the second horizontal pivoting axis.

8. Mining machine in accordance with claim 7, characterized in that the slewing ring carries a counterweight on a side of the slewing ring opposite from the conveyor suspension device, and the positioning mechanism is part of a moving mechanism for the counterweight.

9. Mining machine in accordance with claim 1, characterized in that the second transport device comprises a continuously revolving transport belt which, at its ends on both sides of the second transport device, is guided over an upper drive roller and a lower return roller, and that the upper drive roller is movable via a belt tensioning device including a grease tensioner for the purpose of tensioning the transport belt.

10. Mining machine in accordance with claim 9, characterized in that a grease feeding device extending along the second transport device is provided for the grease tensioner and includes, at the lower end of the second transport device or at the machine frame, a grease feeding connection.

11. Method for the removal and installation of a transport device in a mining machine for the processing of a ground, in which mining material processed by a cutting drum is discharged onto a first transport device permanently installed in the machine frame, the mining material is discharged, at an upper end of the first transport device onto a lower end of a slewable second transport device at a point of acceptance, the second transport device is carried by a conveyor suspension device which is mounted to slew about a vertical slewing axis and can be slewed laterally together with the second transport device, and the second transport device is additionally pivotable, relative to the conveyor suspension device, about a first horizontal pivoting axis, where the vertical slewing axis runs through the point of acceptance, characterized in that the conveyor suspension device together with the second transport device is pivoted, relative to the machine frame, about a second horizontal pivoting axis, which is offset vertically upwards relative to the first pivoting axis, until a free upper end of the first transport device no longer overlaps with the lower end of the second transport device, and the first transport device is lowered to the ground after pivoting of the conveyor suspension device and after detachment of the first transport device from the machine frame.

12. Method in accordance with claim 11, characterized in that the second horizontal pivoting axis, at least during pivoting, is located a distance from the ground that is larger than a direct distance between the second horizontal pivoting axis and the lower end of the second transport device.

13. Method in accordance with claim 11, characterized in that the conveyor suspension device is locked in the working position or in the pivoting position.

14. A mining machine for processing a ground surface, comprising:

a machine frame;

a cutting drum mounted in the machine frame;

a first conveyor having a lower end and an upper end, the lower end located to receive mining material from the cutting drum;

a slewing device pivotally mounted on the machine frame to slew about a vertical axis relative to the machine frame;

a conveyor suspension device pivotally mounted to the slewing device to pivot about an upper horizontal pivoting axis relative to the slewing device between an operating position and pivoted position; and a second conveyor having an upper end and a lower end, the second conveyor being pivotally mounted on the conveyor suspension device to pivot about a lower horizontal pivoting axis relative to the conveyor suspension device, the lower end of the second conveyor being located below the upper end of the first conveyor when the conveyor suspension device is in the operating position relative to the slewing device.

15. The mining machine of claim 14, wherein a distance between the upper horizontal pivoting axis and the ground surface is greater than a distance from the upper horizontal pivoting axis to the lower end of the second conveyor, so that the lower end of the second conveyor stays clear of the ground surface as the conveyor suspension device and the second conveyor are pivoted about the upper horizontal pivoting axis from the operating position to the pivoted position.

16. The mining machine of claim 14, further comprising:

a lock for locking the conveyor suspension device in a selected one of the operating position and the pivoted position.

17. The mining machine of claim 14, wherein:

when the conveyor suspension device is located in the pivoted position the lower end of the second conveyor is no longer below the upper end of the first conveyor, so that the upper end of the first conveyor can be lowered to the ground surface for removal from the mining machine.

18. The mining machine of claim 14, further comprising:

a movable counterweight located on a side of the slewing device opposite from the second conveyor;

a positioning mechanism connected to the movable counterweight for moving the counterweight relative to the slewing device; and wherein the positioning mechanism is also connected to the conveyor suspension device so that the moving mechanism can pivot the conveyor suspension device between its operating position and its pivoted position.

* * * * *